US008779682B2

(12) United States Patent
Choi et al.

(10) Patent No.: US 8,779,682 B2
(45) Date of Patent: Jul. 15, 2014

(54) ILLUMINATION DRIVING APPARATUS

(75) Inventors: Joong Ho Choi, Gyunggi-do (KR); Yeun Joong Lee, Seoul (KR); Deuk Hee Park, Gyunggi-do (KR); Sang Hyun Cha, Seoul (KR); Chang Seok Lee, Seoul (KR)

(73) Assignees: Samsung Electro-Mechanics Co., Ltd., Suwon, Gyeonggi-do (KR); University of Seoul Industry Cooperation Foundation, Seoul (KR)

( * ) Notice: Subject to any disclaimer, the term of this patent is extended or adjusted under 35 U.S.C. 154(b) by 155 days.

(21) Appl. No.: 13/290,738

(22) Filed: Nov. 7, 2011

(65) Prior Publication Data

US 2012/0319605 A1 Dec. 20, 2012

(30) Foreign Application Priority Data

Jun. 14, 2011 (KR) ..... 10-2011-0057378

(51) Int. Cl.
*H05B 37/02* (2006.01)

(52) U.S. Cl.
USPC ..... 315/291; 315/219; 315/307

(58) Field of Classification Search
USPC ..... 315/121, 122, 185 R, 193, 224, 246, 315/291, 294, 297, 307, 308, 312, 320
See application file for complete search history.

(56) References Cited

U.S. PATENT DOCUMENTS

2007/0024213 A1* 2/2007 Shteynberg et al. ..... 315/291
2010/0079081 A1* 4/2010 Zhang et al. ..... 315/291
2011/0285301 A1* 11/2011 Kuang et al. ..... 315/200 R

FOREIGN PATENT DOCUMENTS

JP 2009-026544 2/2009

* cited by examiner

*Primary Examiner* — Alexander H Taningco
*Assistant Examiner* — Christopher Lo
(74) *Attorney, Agent, or Firm* — McDermott Will & Emery LLP

(57) ABSTRACT

A fixture-compatible, dimmable illumination driving apparatus including: a rectifying unit rectifying a phase-controlled waveform of an alternating current (AC) power; a comparing unit comparing an output waveform of the rectifying unit with a first voltage according to a preset reference clock; a reference voltage generating unit generating a reference voltage corresponding to the number of high signals higher than the first voltage among outputs of the comparing unit during one cycle of the output waveform; and a pulse width modulation (PWM) signal generating unit generating a PWM signal from the reference voltage and a feedback voltage.

10 Claims, 4 Drawing Sheets

ILLUMINATION DRIVING APPARATUS

CROSS-REFERENCE TO RELATED APPLICATIONS

This application claims the priority of Korean Patent Application No. 10-2011-0057378 filed on Jun. 14, 2011, in the Korean Intellectual Property Office, the disclosure of which is incorporated herein by reference.

BACKGROUND OF THE INVENTION

1. Field of the Invention

The present invention relates to an illumination driving apparatus capable of using a dimming-adjusted input power.

2. Description of the Related Art

A light emitting device (LED) indicates a semiconductor device capable of implementing various colors of light through alight emitting source using a compound semiconductor made of a material such as gallium arsenide (GaAs), aluminum gallium arsenide (AlGaAs), gallium nitride (GaN), and indium gallium phosphide (InGaP). This type of light emitting device has rapidly replaced an existing illumination fixture due to advantages such as excellent monochromatic peak wavelength, excellent light efficiency, a small size, environmental friendliness, low power consumption, and the like.

In most of light emitting device driving circuits according to the related art, a scheme of rectifying commercial alternating current (AC) power and then supplying a constant current to the light emitting device by using a converter such as a flyback converter, or the like, has been used. These driving apparatuses need to have compatibility such that they may be used in an existing illumination fixture using a Triac dimmer, or the like. To this end, there is a scheme of detecting and averaging an output voltage of a Triac dimmer and using the averaged output voltage for power conversion.

However, the scheme according to the related art may not accurately detect a degree to which an input AC power is dimmed due to an error in a process of detecting and averaging a voltage, such that it may not drive the light emitting device so as to satisfy requirements of a user.

SUMMARY OF THE INVENTION

An aspect of the present invention provides an illumination driving apparatus capable of accurately detecting a degree to which an alternating current (AC) power is dimmed in a Triac dimmer to thereby drive a light emitting device while reflecting the dimming degree.

According to an aspect of the present invention, there is provided an illumination driving apparatus including: a rectifying unit rectifying a phase-controlled waveform of an alternating current (AC) power; a comparing unit comparing an output waveform of the rectifying unit with a first voltage according to a preset reference clock; a reference voltage generating unit generating a reference voltage corresponding to the number of high signals higher than the first voltage among outputs of the comparing unit during one cycle of the output waveform; and a pulse width modulation (PWM) signal generating unit generating a PWM signal from the reference voltage and a feedback voltage.

The reference voltage generating unit may include a shift register sequentially storing the outputs of the comparing unit output according to the reference clock; a register storing data corresponding to one cycle of the output waveform when the data is stored in the shift register; and a voltage generating unit generating the reference voltage based on a value of the data stored in the register.

According to another aspect of the present invention, there is provided an illumination driving apparatus including: a rectifying unit rectifying a phase-controlled waveform of an alternating current (AC) power; a comparing unit comparing an output waveform of the rectifying unit with a first voltage according to a preset reference clock; a reference voltage generating unit calculating the number of high signals higher than the first voltage among outputs of the comparing unit during one cycle of the output waveform when one of the high signals is initially applied during one cycle of the output waveform and then generating a reference voltage corresponding to the number of the high signals; and a pulse width modulation (PWM) signal generating unit generating a PWM signal from the reference voltage and a feedback voltage.

The reference voltage generating unit may include a shift register sequentially storing the outputs of the comparing unit outputted according to the reference clock; a detecting unit detecting that a high signal is initially stored in the shift register during one cycle of the output waveform; a register storing data of the shift register when the high signal is initially detected in the detecting unit and storing bits after a position at which the high signal is detected as being high; and a voltage generating unit generating the reference voltage based on a value of the data stored in the register.

The reference voltage generating unit may include a shift register sequentially storing the outputs of the comparing unit output according to the reference clock; a detecting unit detecting that one of the high signals is initially stored in the shift register during one cycle of the output waveform; a register storing data of the shift register when one of the high signals is initially detected in the detecting unit; and a voltage generating unit generating the reference voltage based on a value of the data stored in the register, the shift register regarding all remaining outputs of the comparing part as high signals during one cycle of the output waveform when the detecting unit detects that one of the high signals is initially stored.

In the aspects of the present invention, the illumination driving apparatus may further include a clock generating unit generating the reference clock and a pulse indicating that one cycle of the output waveform has ended.

The reference clock may have a cycle corresponding to a value obtained by dividing one cycle of the output waveform by an integer.

The illumination driving apparatus may further include a Triac dimmer controlling a phase of the AC power; a DC/DC converting unit converting an output level of the rectifying unit according to the PWM signal; a plurality of light emitting diodes connected to an output terminal of the DC/DC converting unit; and a feedback voltage unit generating the feedback voltage from an output voltage of the DC/DC converting unit.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE INVENTION

Figure 1:
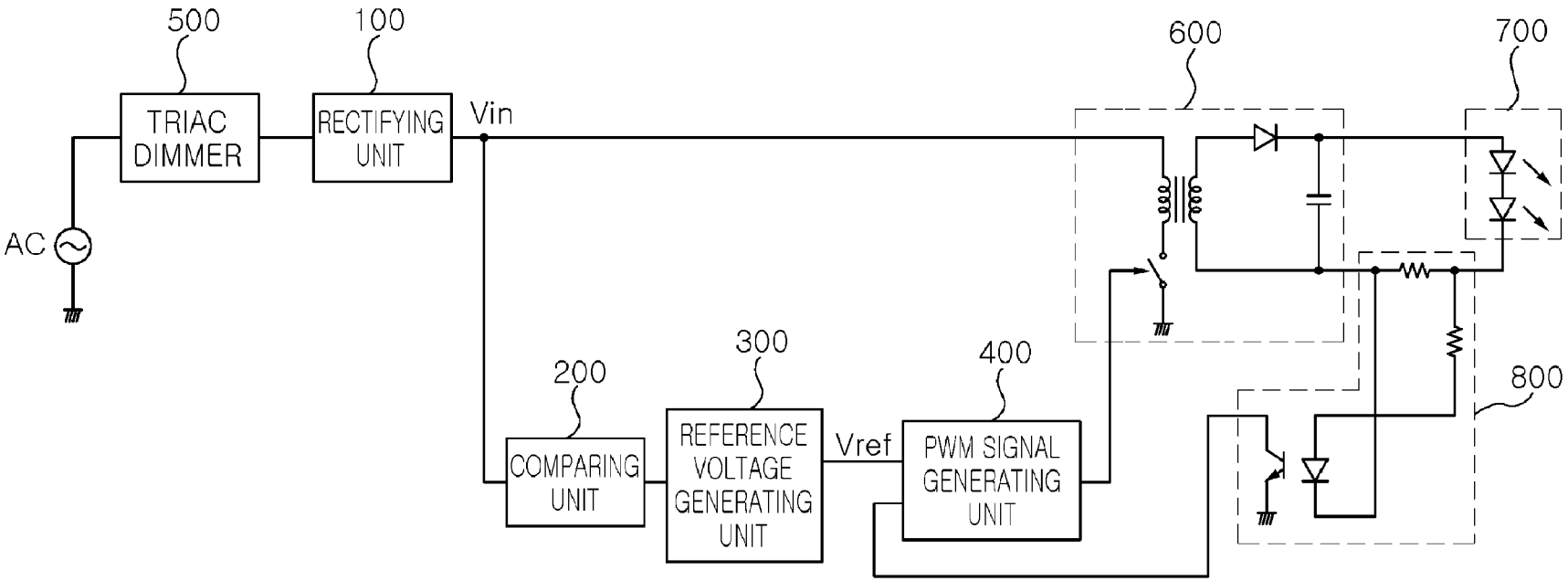
FIG. 1 is a configuration diagram of an illumination driving apparatus according to an embodiment of the present invention.

Embodiments of the present invention will now be described in detail with reference to the accompanying drawings.

The present invention should not be seen as being limited to the embodiments set forth herein and the embodiments may be used to assist in understanding the technical idea of the present invention. Like reference numerals designate like components having substantially the same constitution and function in the drawings of the present invention.

FIG. 1 is a configuration diagram of an illumination driving apparatus according to an embodiment of the present invention.

Referring to FIG. 1, an illumination driving apparatus according to an embodiment of the present invention may include a rectifying unit 100, a comparing unit 200, a reference voltage generating unit 300, and a pulse width modulation (PWM) signal generating unit 400. The illumination driving apparatus may further include a Triac dimmer 500, a rectifying unit 100, a direct current (DC)/DC converting unit 600, a light emitting diode 700, and a feedback voltage unit 800.

The Triac dimmer 500 may receive a commercial alternating current (AC) power and phase-control a waveform of the AC power. Here, the Triac dimmer 500, which is an existing illumination fixture, may be embedded in a wall, or the like, of a building.

The rectifying unit 100 may full-wave rectify the AC waveform phase-controlled in the Triac dimmer 500. Here, the rectifying unit 100 may be formed of a bridge diode.

The DC/DC converting unit 600 may convert an output of the rectifying unit 100 into a predetermined voltage level. Here, the DC/DC converting unit 600 may be formed of a flyback converter as shown in FIG. 1. However, the flyback converter shown in FIG. 1 is only an example, and converters capable of using a switching scheme, such as a forward converter, or the like, may be used.

The light emitting diode 700 may receive a output voltage having the voltage level controlled in the DC/DC converting unit 600 to thereby be operated as a light source. Although FIG. 1 shows two light emitting diodes 700 connected in series by way of example, the light emitting diode may be provided to have various amounts and disposition structures.

The feedback voltage unit 800 may generate a feedback voltage from the output voltage of the DC/DC converting unit 600. Information regarding this feedback voltage may be transferred to a primary side of the DC/DC converting unit 600 through a photocoupler.

The PWM signal generating unit 400 may generate a PWM signal for controlling a switch of the DC/DC converting unit 600 from the feedback voltage and a reference voltage. Here, the PWM signal generating unit 400 may generate the PWM signal through an error amplifier (not shown) comparing the feedback voltage and the reference voltage to thereby amplify an error and a comparator (not shown) comparing an output of the error amplifier and a triangular wave generated in a triangular wave generator (not shown).

Therefore, in order to allow a voltage or a current supplied to the light emitting diode 700 to be constant and satisfy a dimming level required by a user, the reference voltage inputted to the PWM signal generating unit 400 needs to accurately reflect dimming information.

The comparing unit 200 may compare a waveform Vin of the output ("output waveform Vin") from the rectifying unit 100 and a preset first voltage VLV. Here, the comparing unit 200 may perform the comparison according to reference clocks. That is, describing an operation of the comparing unit 200 based on one cycle of the output waveform Vin of the rectifying unit 100, the comparing unit 200 compares the output waveform Vin of the rectifying unit 100 and the first voltage VLV in terms of the number of reference clocks generated during one cycle, and outputs results of the comparison. Here, the first voltage VLV may be set to a value significantly lower than that of a maximum peak (for example, 1/100 of the maximum peak) of the output waveform Vin from the rectifying unit 100.

The reference voltage generating unit 300 may generate a reference voltage corresponding to the number of high signals higher than the first voltage VLV among outputs of the comparing unit 200 during one cycle of the output waveform Vin of the rectifying part 100. A detailed description of the reference voltage generating unit 300 will be provided in a description of FIGS. 2 through 4 below.

Figure 2:
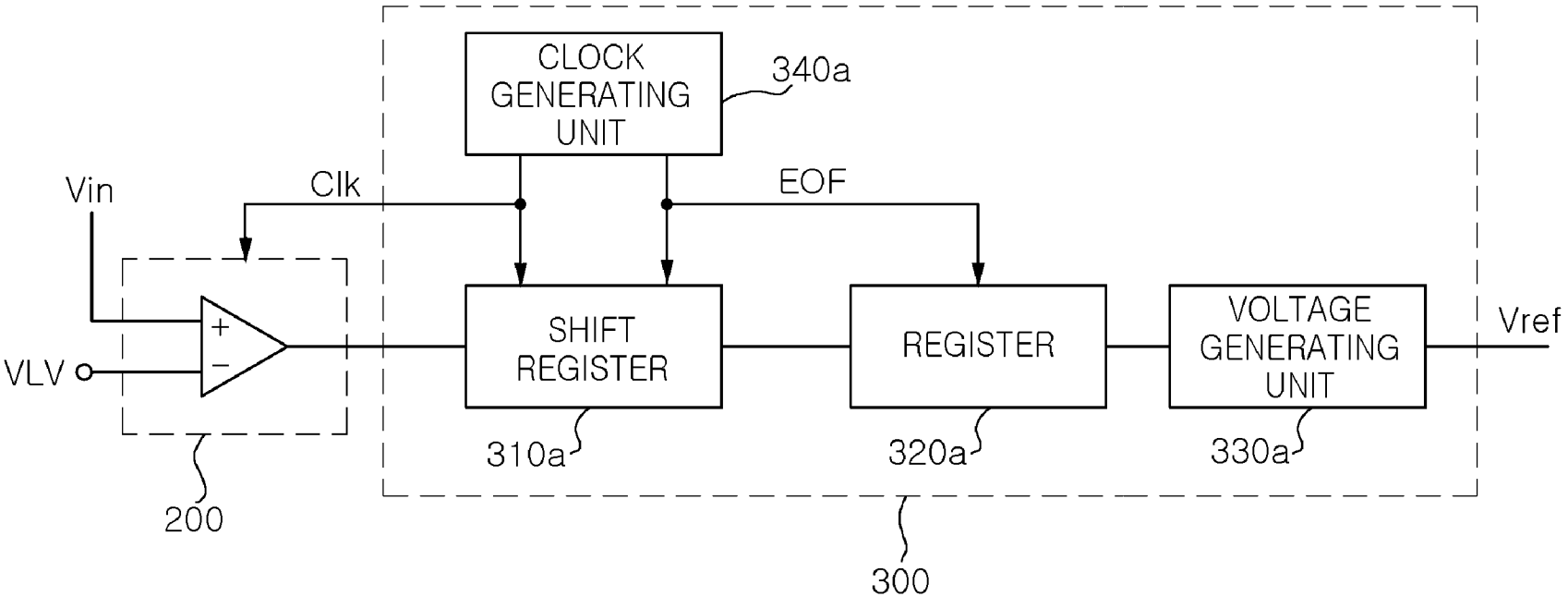
FIG. 2 is a detailed view of a comparing unit and a reference voltage generating unit according to an embodiment of the present invention.

FIG. 2 is a detailed view of the comparing unit 200 and the reference voltage generating unit 300 according to an embodiment of the present invention; and FIGS. 4A through 4E show a timing chart describing measurement of a dimming degree in the comparing unit 200 and the reference voltage generating unit 300 of an illumination driving apparatus according to an embodiment of the present invention.

Referring to FIG. 2, the reference voltage generating unit 300 may include a shift register 310*a*, a register 320*a*, a voltage generating unit 330*a*, and a clock generating unit 340*a*.

The comparing unit 200 may compare the first voltage VLV and the output waveform Vin from the rectifying unit 100 according to a reference clock Clk and output a result of the comparison to the shift register 310*a*, as described above in the description of FIG. 1. FIG. 4A shows a waveform of an AC power phase-controlled into the output waveform Vin of the rectifying unit 100 in the Triac dimmer 500 according to the requirement of a user. This phase-controlled waveform is compared with the first voltage VLV of FIG. 4B according to the reference clock Clk of FIG. 4C.

Figure 4:
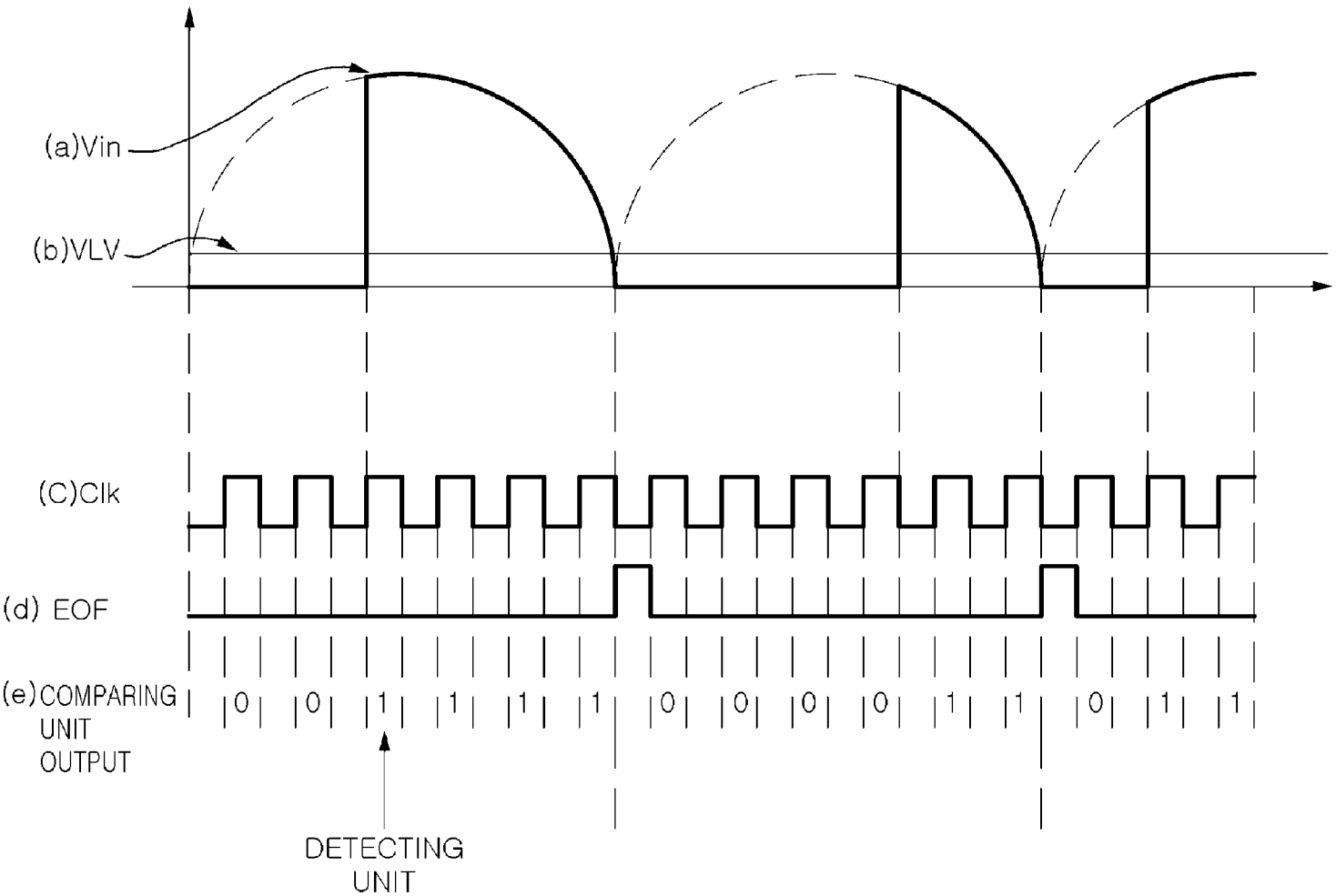
FIGS. 4A through 4E show a timing chart describing measurement of a dimming degree in a comparing unit and a reference voltage generating unit of an illumination driving apparatus according to an embodiment of the present invention.

Therefore, since the comparing unit 200 performs the comparison in a high signal period of the reference clock Clk, it may sequentially output 0, 0, 1, 1, 1, and 1 bit by bit during one cycle of the output waveform of the rectifying unit 100, as shown in FIG. 4E. Although FIG. 4 shows a case in which the reference clock Clk has a relatively large cycle for a conceptual description, the reference clock Clk may have a small cycle satisfying a condition in which it corresponds to a value obtained by dividing one cycle of the output waveform of the rectifying unit 100 by an integer.

Again referring to FIG. 2, data sequentially outputted bit by bit from the comparing unit 200 may be sequentially stored in the shift register 310*a*. Here, the shift register 310*a* may have a capacity capable of storing the output of the comparing unit 200 during one cycle of the output waveform of the rectifying unit 100.

In addition, the shift register 310*a* may receive from the clock generating unit 340 to be described below, the reference clock Clk and a pulse EOF indicating that one period of the output waveform of the rectifying unit 100 has ended. The shift register 310*a* may sequentially transfer and store data outputed from the comparing unit 200 according to the reference clock Clk, and may be reset when it receives the pulse EOF.

In the case in which data corresponding to one cycle of the output waveform of the rectifying unit 100 is stored in the shift register 310*a*, the register 320*a* may store the data as it is. Similar to the shift register 310*a*, the register 320*a* may also receive the pulse (EOF) and may be reset according to the pulse (EOF).

The clock generating unit 340*a* may generate the reference clock Clk supplied to the shift resistor 310*a* and the comparing unit 200 and having a predetermined cycle. In addition, the clock generating unit 340*a* may generate the pulse EOF indicating that one cycle of the output waveform of the rectifying unit 100 supplied to the shift register 310*a* and the register 320*a* has ended. Here, the clock generating unit 340*a* may include a crystal oscillator, or the like.

The voltage generating unit 330*a* may generate a reference voltage corresponding to the number of 1's among data stored in the register 320*a*. Therefore, the generated reference voltage may include accurate information dimmed in the Triac dimmer 500. In addition, when the reference voltage is generated, a memory for a lookup table, or the like, is not required.

Figure 3:
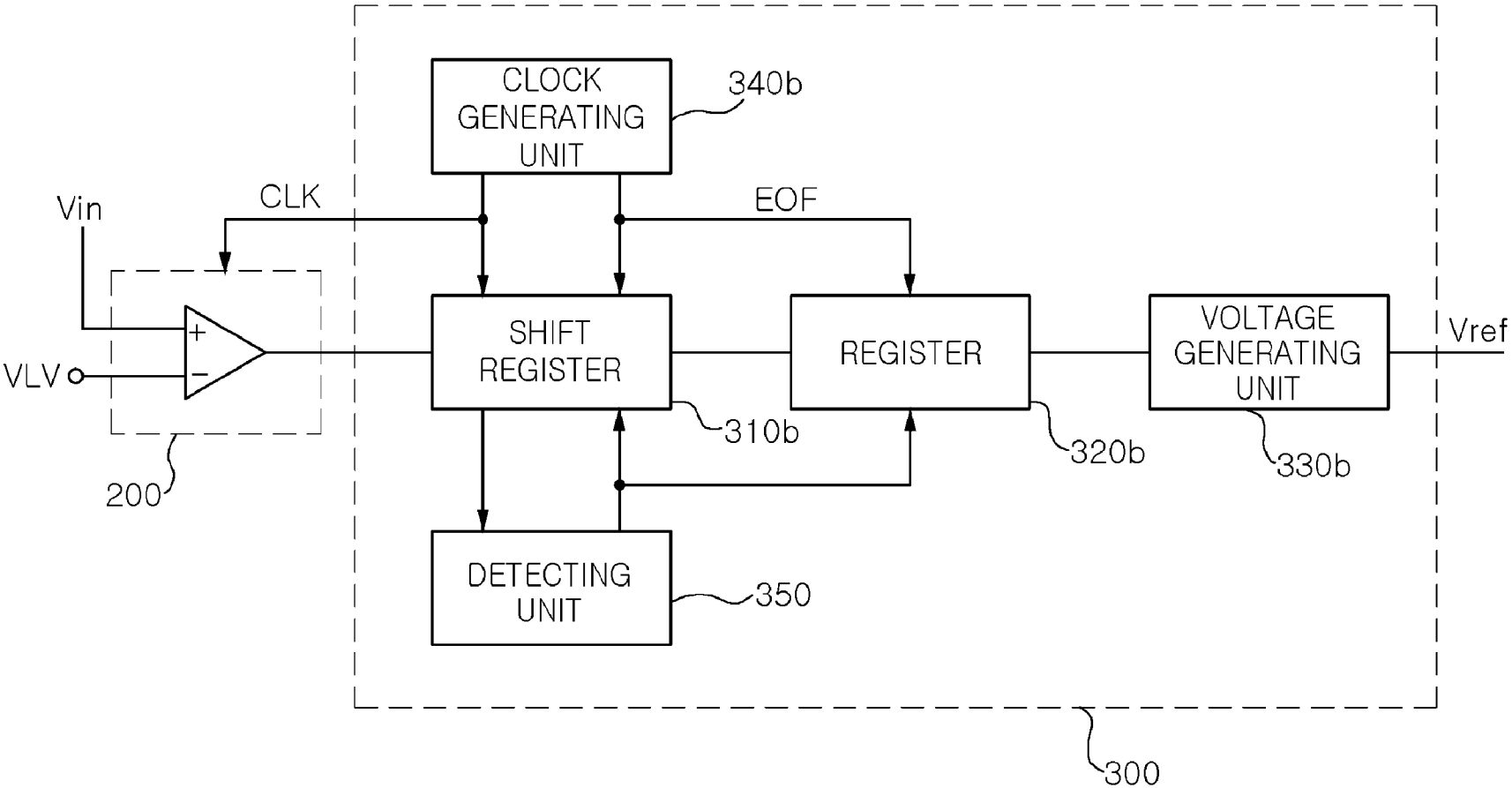
FIG. 3 is a detailed view of a comparing unit and a reference voltage generating unit according to another embodiment of the present invention.

FIG. 3 is a detailed view of the comparing unit 200 and the reference voltage generating unit 300 according to another embodiment of the present invention. Hereinafter, the reference voltage generating unit 300 according to another embodiment of the present invention will be described in detail with reference to FIGS. 3 and 4.

Referring to FIG. 3, the reference voltage generating unit 300 may further include a detecting unit 350, unlike the reference voltage generating unit of FIG. 2 and may recognize a dimming degree of the AC power before all outputs of the comparing unit 200 during one cycle of the output waveform of the rectifying unit 100 are inputted to a shift register 310*b*.

A clock generating unit 340*b* may generate the reference clock Clk and the pulse (EOF) indicating that one cycle of the output waveform of the rectifying unit 100 has ended. The reference clock Clk and the pulse EOF may be synchronized with the output waveform of the rectifying unit 100. More specifically, an initial cycle of the output waveform of the rectifying unit 100 is compared through the comparing unit 200, and a point at which the output waveform of the rectifying unit initially changes from 1 to 0 is detected in the detecting unit 350. When the above-mentioned operation is repeated in the next cycle, information regarding one cycle of the output waveform of the rectifying unit 100 may be obtained. The reference clock Clk and the pulse EOF may be synchronized with the output waveform of the rectifying unit 100 using this information.

The detecting unit 350 may detect information in which a "1" is initially stored by checking bits sequentially inputted to the shift register 310*b*. This detected information may be provided to the shift register 310*b* or a register 320*b*.

When information in which a "1" is initially stored is provided from the detecting unit 350 to the shift register 310*b*, the shift register 310*b* may regard all bits to be subsequently stored as 1 and provide date to the register 320*b*.

Alternatively, when information in which a "1" is initially stored in the detecting unit 350 is provided from the detecting unit 350 to the register 320*b*, the register 320*b* may store a combination of 0 and 1 based on this information.

The voltage generating unit 330*b* may generate the reference voltage corresponding to the number of 1's among data stored in the register 320*b*, similar to the description of FIG. 2.

That is, the reference voltage generating unit 300 shown in FIG. 3 uses a property in which the output of the comparing unit 200 is initially 0 and after a predetermined time, becomes 1, during one cycle of the output waveform of the rectifying unit 100, due to characteristics of the phase-controlled waveform outputted from the Triac dimmer 500. Therefore, the reference voltage generating unit 300 may rapidly detect a dimming degree of AC power to thereby generate the reference voltage while reflecting the dimming degree, unlike the reference voltage generating unit 300 of FIG. 2. In addition, the reference voltage generating unit 300 may generate the reference voltage while accurately reflecting the dimming degree, similar to the reference voltage generating unit 300 of FIG. 2.

As set forth above, the illumination driving apparatus according to the embodiments of the present invention may accurately detect the degree to which the AC power is dimmed to thereby maintain compatibility with the existing illumination fixture while driving the light emitting device so as to satisfy the requirements of a user. In addition, the illumination driving apparatus according to the embodiments of the present invention may rapidly detect the dimming and reflect the detected dimming in the light emitting device.

While the present invention has been shown and described in connection with the embodiments, it will be apparent to those skilled in the art that modifications and variations can be made without departing from the spirit and scope of the invention as defined by the appended claims.

What is claimed is:

1. An illumination driving apparatus comprising:

a rectifying unit rectifying a phase-controlled waveform of an alternating current (AC) power;

a comparing unit comparing an output waveform of the rectifying unit with a first voltage according to a preset reference clock;

a reference voltage generating unit sequentially storing outputs of the comparing unit, and generating a reference voltage corresponding to the number of high signals higher than the first voltage among the sequentially stored outputs of the comparing unit during one cycle of the output waveform; and a pulse width modulation (PWM) signal generating unit generating a PWM signal from the reference voltage and a feedback voltage, wherein the reference voltage generating unit includes:

a shift register sequentially storing the outputs of the comparing unit output according to the reference clock;

a register storing data corresponding to one cycle of the output waveform when the data is stored in the shift register; and a voltage generating unit generating the reference voltage based on a value of the data stored in the register.

2. The illumination driving apparatus of claim 1, wherein the reference voltage generating unit further includes a clock generating unit generating the reference clock and a pulse indicating that one cycle of the output waveform has ended.

3. The illumination driving apparatus of claim 1, wherein the reference clock has a cycle corresponding to a value obtained by dividing one cycle of the output waveform by an integer.

4. The illumination driving apparatus of claim 1, further comprising:

a Triac dimmer controlling a phase of the AC power;

a direct current (DC)/DC converting unit converting an output level of the rectifying unit according to the PWM signal;

a plurality of light emitting diodes connected to an output terminal of the DC/DC converting unit; and a feedback voltage unit generating the feedback voltage from an output voltage of the DC/DC converting unit.

5. An illumination driving apparatus comprising:

a rectifying unit rectifying a phase-controlled waveform of an alternating current (AC) power;

a comparing unit comparing an output waveform of the rectifying unit with a first voltage according to a preset reference clock;

a reference voltage generating unit sequentially storing outputs of the comparing unit, calculating the number of high signals higher than the first voltage among the sequentially stored outputs of the comparing unit during one cycle of the output waveform when one of the high signals is initially applied during one cycle of the output waveform and then generating a reference voltage corresponding to the number of the high signals; and a pulse width modulation (PWM) signal generating unit generating a PWM signal from the reference voltage and a feedback voltage, wherein the reference voltage generating unit includes:

a shift register sequentially storing the outputs of the comparing unit output according to the reference clock;

a detecting unit detecting that a high signal is initially stored in the shift register during one cycle of the output waveform;

a register storing data of the shift register when the high signal is initially detected in the detecting unit and storing bits after a position at which the high signal is detected as being high; and a voltage generating unit generating the reference voltage based on a value of the data stored in the register.

6. The illumination driving apparatus of claim 5, wherein the shift register regards all remaining outputs of the comparing part as high signals during one cycle of the output waveform when the detecting unit detects that one of the high signals is initially stored.

7. The illumination driving apparatus of claim 5, wherein the reference voltage generating unit further includes a clock generating unit generating the reference clock and a pulse indicating that one cycle of the output waveform has ended.

8. The illumination driving apparatus of claim 5, wherein the reference clock has a cycle corresponding to a value obtained by dividing one cycle of the output waveform by an integer.

9. The illumination driving apparatus of claim 5, further comprising:

a Triac dimmer controlling a phase of the AC power;

a DC/DC converting unit converting an output level of the rectifying unit according to the PWM signal;

a plurality of light emitting diodes connected to an output terminal of the DC/DC converting unit; and a feedback voltage unit generating the feedback voltage from an output voltage of the DC/DC converting unit.

10. The illumination driving apparatus of claim 6, wherein the reference voltage generating unit further includes a clock generating unit generating the reference clock and a pulse indicating that one cycle of the output waveform has ended.

* * * * *